US012623159B2

(12) United States Patent
Ables et al.

(10) Patent No.: US 12,623,159 B2
(45) Date of Patent: May 12, 2026

(54) ROLE PLAY FIRST AID KIT AND SIMULATED BANDAGE

(71) Applicant: Melissa & Doug, LLC, Wilton, CT (US)

(72) Inventors: Cristina Ables, Riverview, FL (US); Jeffrey Butler, Rye Brook, NY (US)

(73) Assignee: Melissa & Doug, LLC, Wilton, CT (US)

( * ) Notice: Subject to any disclaimer, the term of this patent is extended or adjusted under 35 U.S.C. 154(b) by 284 days.

(21) Appl. No.: 18/224,419

(22) Filed: Jul. 20, 2023

(65) Prior Publication Data

US 2025/0025804 A1 Jan. 23, 2025

(51) Int. Cl.
*A63H 3/00* (2006.01)
*A63H 33/30* (2006.01)

(52) U.S. Cl.
CPC ..... *A63H 33/3094* (2013.01); *A63H 3/001* (2013.01); *A63H 33/3022* (2013.01); *A63H 2200/00* (2013.01)

(58) Field of Classification Search
CPC ..... A63H 3/001; A63H 33/00; A63H 33/22; A63H 33/3094
See application file for complete search history.

(56) References Cited

U.S. PATENT DOCUMENTS 2,781,611 A * 2/1957 West ..... A63H 3/001 446/295
2,959,891 A * 11/1960 Barnett ..... A63H 3/52 446/295
3,858,351 A 1/1975 Porter
4,257,188 A * 3/1981 Barker ..... A63H 3/001 446/305
5,032,102 A * 7/1991 Davidson ..... A63H 3/365 446/268
5,314,339 A * 5/1994 Aponte ..... G09B 23/285 434/262

(Continued)

OTHER PUBLICATIONS

GB Application No. 2410607.2: Search Report under Section 17 mailed Dec. 19, 2024.

(Continued)

*Primary Examiner* — John A Ricci
(74) *Attorney, Agent, or Firm* — Aird & McBurney LP

(57) ABSTRACT

A kit for creating and healing a simulated wound includes a fabric patch that can be saturated with a liquid to become translucent. The patch includes an image of a simulated wound, such as a cut, scratch, or abrasion. Water is applied to a person's skin. The patch is applied to the wetted skin and is saturated by the water, causing the fabric forming the patch to become translucent so that the color of the user's skin is at least partially visible through the patch. This creates the illusion that the simulated wound image is an actual injury. The kit also includes a simulated bandage. The bandage has a gripping portion, such as a patch of "hook" materials from a "hook-and-loop" fastener, on its bottom surface. When the gripping portion of the bandage is contacted with the patch, the gripping portion engages with the fabric so that when the bandage is pulled away from the skin, the patch and the simulated wound are also pulled away from the skin, creating the illusion that the wound has been healed.

19 Claims, 14 Drawing Sheets

(56) References Cited

U.S. PATENT DOCUMENTS

| | | | | |
|---|---|---|---|---|
| 5,326,612 | A * | 7/1994 | Goulait | A44B 18/0011 428/220 |
| 6,004,136 | A * | 12/1999 | Ehrenpreis | G09B 23/28 446/295 |
| 6,455,752 | B1 * | 9/2002 | Vesey | A61F 13/0259 602/41 |
| 7,083,419 | B2 * | 8/2006 | Winslow | G09B 23/30 434/273 |
| 2016/0270968 | A1 | 9/2016 | Standford et al. | |
| 2017/0252221 | A1 | 9/2017 | Scopelliti | |
| 2019/0192352 | A1 * | 6/2019 | Rivest | A61L 15/58 |
| 2023/0285195 | A1 | 9/2023 | Friedman | |
| 2024/0016974 | A1 * | 1/2024 | Rivest | A61F 13/0253 |

OTHER PUBLICATIONS

EP Application No. 24189762.8: European Search Report mailed Dec. 18, 2024.

* cited by examiner

ROLE PLAY FIRST AID KIT AND SIMULATED BANDAGE

BACKGROUND OF THE INVENTION

1. Field of the Invention

The present disclosure relates to a simulated wound that can be removably applied to a user's skin to create the appearance of an actual wound, such as a cut, scrap, or abrasion. The present disclosure further relates to a simulated bandage that allows a user to pretend to treat a simulated wound on the user's skin. More particularly, the present disclosure relates to a patch that, when wetted, shows a simulated wound on the skin and to a simulated bandage that, when applied to the wetted patch, pulls the patch from the skin, creating the illusion that the wound has been healed. The present disclosure further relates to a kit including such patches, simulated bandages, and accessories related to administering first aid.

2. Description of the Related Art

Children enjoy playing games where they have the sensation that they are acting as an adult. Toys that allow children to pretend to act as medical professionals are well known. Such toys may provide children with simulated medical instruments, such a syringes, stethoscopes, tweezers, medicine bottles, and the like. A child can manipulate these objects while pretending to be a doctor, nurse, or other health professional. Such toys allow a child to use his or her imagination, to envision a visit to the doctor or hospital, and to pretend to heal themselves and their playmates. Such toys may also help children facing actual health problems better cope with frightening medical experiences by enacting situations for themselves.

The experience of playing with toys that simulate medical procedures may be more engaging if the procedure seems more realistic. For example, a child may pretend that she or her playmate has a cut or scratch. The child may enjoy applying real bandages to herself or her playmates to pretend to treat the wound. Since there is no actual wound, the child must imagine it and image that the wound has healed when the bandage is removed.

There is a need for a toy that creates a realistic-looking simulated wound and that allows the child to pretend to treat that wound.

BRIEF SUMMARY OF THE INVENTION

Embodiments of the disclosure provide a toy that includes a mechanism to simulate a skin wound, such as a scratch, abrasion, cut, insect bite or a suture. According to one aspect, such a wound is simulated by a patch of fabric that is opaque or nearly opaque when dry and that has a simulated wound printed on the fabric. The patch is applied to skin and saturated with water. The material forming the patch becomes translucent when wetted. The simulated wound and the skin beneath the patch become visible through the patch, creating the illusion that that there is an actual wound on the skin.

According to one aspect of the disclosure, the simulated wound is printed in colors that contrast with the skin to enhance the visual impact of the wound. According to another aspect, a plurality of patches are provided as part of a kit printed with a variety of simulated wounds. The user can select a particular simulated wound and imagine a scenario that logically connects with the wound selected. For example, the child may envision having fallen down and scraped her hand. The child might select a patch with a simulated abrasion. As part of her play, the child would apply the patch to her hand and wet the patch to create what looks like an abrasion.

According to another aspect, the patch is thin and flexible to conform to the skin. Once the patch has been placed on the skin and wetted, capillary forces between the wetted patch and the skin hold the patch in contact with the skin. This temporarily fixes the patch to the skin, allowing the child to enact a play scenario involving the simulated wound.

According to another embodiment of the disclosure, a simulated bandage is provided along with one or more of the patches as described above. The simulated bandage has a top side that may be decorated to simulate an actual bandage, such as a Band-Aid® adhesive bandage manufactured by Johnson & Johnson Consumer, Inc. One or more engaging regions are provided on the bottom side of the simulated bandage. According to one embodiment, the engaging regions are covered with flexible hooks, such as the hooks provided as part of a "hook-and-loop" fastener. According to this embodiment, the top surface of the patch is provided with loops, pores, or fibers that engage with the hooks when the bottom side of the simulated bandage is contacted with the top surface of the patch. Once the hooks engage with the patch, the bandage is pulled away from the skin. Because the patch is held to the skin only by capillary forces, the patch, along with the simulated wound lifts away from the skin easily, creating the illusion that the simulated wound has healed. According to one embodiment, the patch is unchanged by the process of adhering and removing from the skin. Such a patch can be reused repeatedly.

According to another embodiment of the disclosure, a plurality of simulated bandages are provided as part of a kit along with one or more patches. Simulated bandages may be provided in a number of shapes and sizes to simulate the shapes and sizes of actual bandages and other first aid products. According to one aspect of the disclosure, simulated bandages are shaped as rectangles, squares, ovals, circles, stars, or any other shape that would simulate a bandage. According to another aspect, the bandage has an extended length to simulate a strip of gauze that can be wrapped around a part of a person's body to simulate a wound dressing.

According to one embodiment, the simulated bandage includes a fastening mechanism that releasably holds one portion of the bandage in connection with another portion of the same bandage. The fastening mechanism may comprise two components of a closure disposed at different locations on the bandage. When the bandage is wrapped around a body part, for example, a user's finger, the two components contact one another to hold the bandage onto the body part. According to one embodiment, the fastening mechanism comprises a hook-and-loop closure. According to a further embodiment, the hook component of the hook-and-loop closure also forms part of the engaging portion and functions to engage with the patch to pull it from the skin. According to another embodiment, the fastening mechanism comprises a magnet closure with a magnet disposed on one portion of the bandage and a ferromagnetic piece on another part of the bandage. Bringing these components together holds the two portions of the bandage together.

According to another embodiment of the disclosure, a water dispenser is provided to deliver water to the user's skin and to the patch to wet the patch as described above.

The water dispenser may be a brush, a nozzle, a sponge, or a sprayer. According to one embodiment, the water dispenser is a container with a reservoir connected to a small opening. Water is delivered by dabbing the opening against the skin and the patch. The size and shape of the opening is selected to limit the flow of water from the reservoir. According to a further embodiment, the dispenser includes a removable cap that engages with the dispenser and closes the opening to keep water in the container when the container is not in use.

BRIEF DESCRIPTION OF THE DRAWINGS

The above and/or other aspects of the disclosure will be more apparent by describing in detail exemplary embodiments of the disclosure with reference to the accompanying drawings, in which.

DETAILED DESCRIPTION OF EXEMPLARY EMBODIMENTS

Figure 1A:
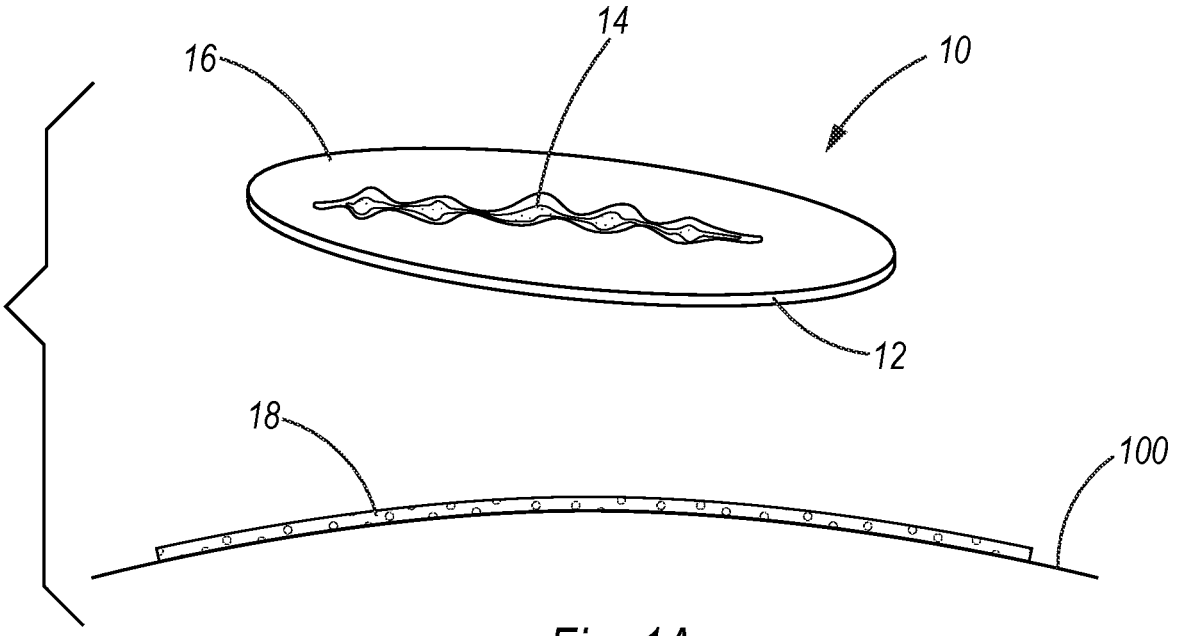
FIGS. 1A, 1B, and 1C illustrate a patch for creating a simulated wound according to embodiments of the disclosure and the steps for applying the patch to the skin of a user to create the simulated wound.

Exemplary embodiments of the disclosure will now be described below by reference to the attached Figures. The described exemplary embodiments are intended to assist the understanding of the invention and are not intended to limit the scope of the invention in any way. Like reference numerals refer to like elements throughout.

FIG. 1A shows a patch 10 according to embodiments of the disclosure. Patch 10 is formed by a fabric layer 12. A simulated wound image 14 is applied to the fabric layer. Fabric layer 12 is formed from a thin flexible material that can be wetted with water or other liquid. The material forming fabric layer 12 is selected to be relatively opaque when dry and that becomes translucent when wetted. According to one embodiment, fabric layer 12 is white or a neutral color. According to another embodiment, fabric layer 12 is formed from a material known to be safe for contact with human skin. According to one embodiment, fabric layer 12 is formed from a woven or non-woven textile, for example, a natural or synthetic textile such as a cotton or wool fabric, gauze, muslin, linen, or a synthetic material such as polyethylene, polypropylene or the like. According to a preferred embodiment, fabric layer 12 is formed from non-woven polypropylene. Fabric layer 12 is preferably thin and flexible to allow patch 10 to conform to curved surfaces, such as the skin on a person's limb. According to a preferred embodiment, fabric layer has a thickness of about 0.2 millimeters ("mm").

According to one embodiment, simulated wound image 14 is applied to fabric layer 12 by printing, such as screen printing, thermal transfer printing, hand drawing, or other technique for applying images to fabric or other sheets of material know to those of skill in the field of the disclosure.

Figure 1B:
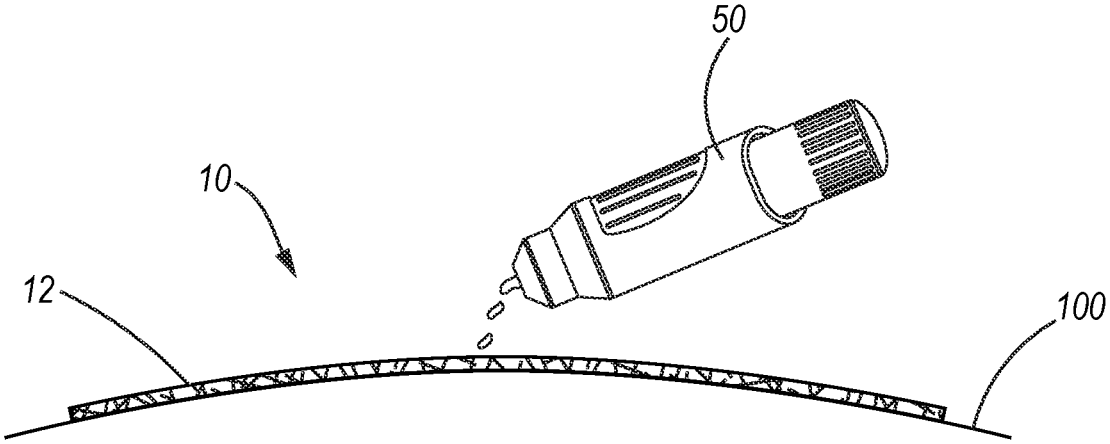
Figure 1C:
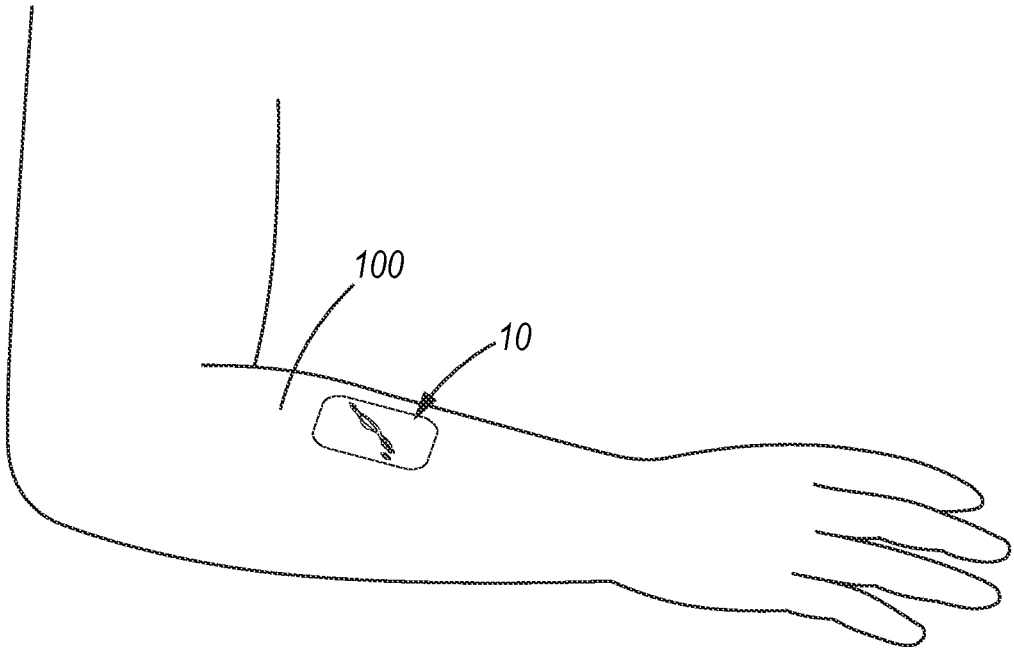

FIGS. 1A, 1B, and 1C show use of patch 10 according to one embodiment of the disclosure. As shown in FIG. 1A, a layer of liquid 18 is applied to a user's skin 100. Liquid layer 18 may be applied by spraying, by brushing, by application using a fingertip or from an applicator, or by immersing the limb in water, for example, while bathing. Once the skin surface 100 is wetted, patch 10 is applied to the skin 100.

As shown in FIG. 1B, additional water may be applied to patch 10 to assure that it is fully saturated. This additional liquid, as well as liquid layer 18, shown in FIG. 1A, could be applied using dispenser pen 50, shown in FIG. 4 and described below. According to one embodiment, the liquid is water. According to other embodiments, other liquids may be used to saturate patch 10 within the scope of the disclosure. The liquid may be an aqueous solution, for example, sea water, or may include a dye solution to simulate blood associated with a simulated wound. The liquid may be a non-aqueous material, for example, mineral oil, petroleum jelly, baby oil, hand lotion, sunscreen, and the like that can safely be applied to a user's skin. According to further embodiments, the liquid may be a combination of liquids.

FIG. 1C shows patch 10 applied to a user's skin 100. Because liquid has permeated patch 10, fabric layer 12 becomes translucent so that the color of the user's skin 100 is at least partially visible through patch 10. As a result, simulated wound image 14 appears to be an actual wound on the skin 100. Surface tension of the liquid layer causes patch 10 to adhere to the skin in the same manner that wet clothing sticks to wet skin. This effect allows patch 10 to remain adhered to skin 100 as long as patch 10 remains saturated. According to one embodiment, the user can apply additional liquid to patch 10, such as shown in FIG. 1B, to maintain adhesion.

Figure 2A:
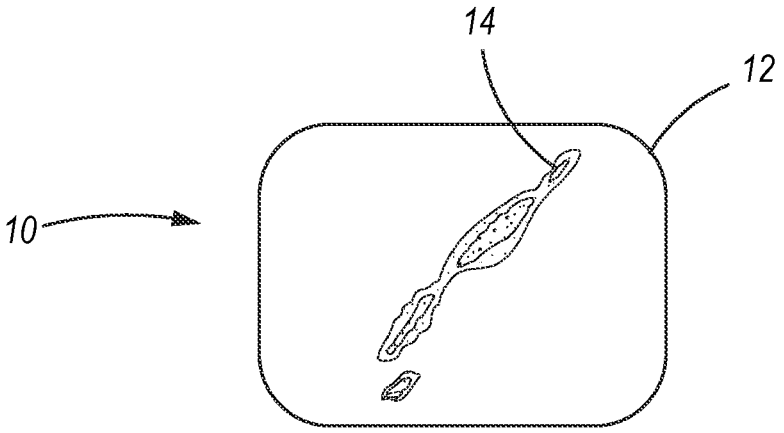
FIGS. 2A, 2B, and 2C show exemplary embodiments of patches, such as the one illustrated in FIGS. 1A, 1B, and 1C, according to embodiments of the disclosure.
Figure 2B:
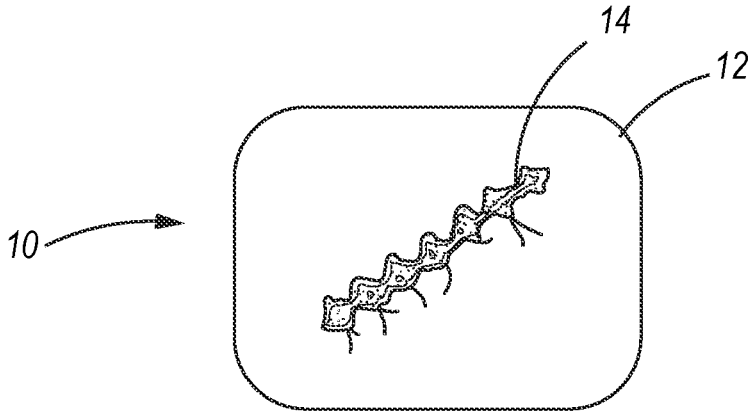
Figure 2C:
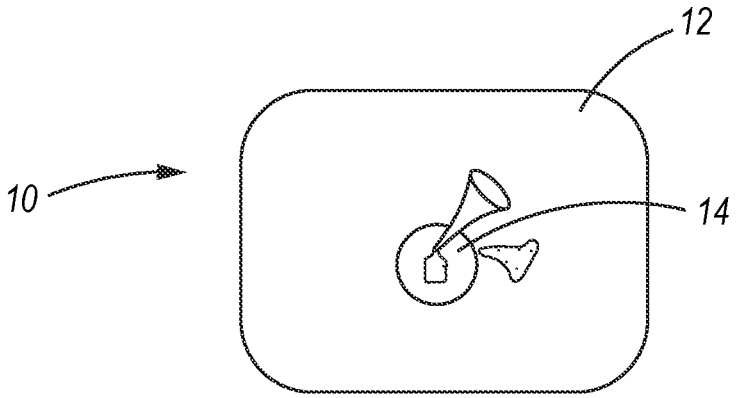

FIGS. 2A to 2C show exemplary embodiments of patches 10 with different simulated wound images 14, for example, a cut or scratch (FIG. 2A), stiches (FIG. 2B), or a thorn puncture (FIG. 2C). These are exemplary images and are not intended to limit the scope of the disclosure. Other images might also be applied to patch 12, for example, of a simulated tattoo or body piercing, or of a different kind of wound.

Figure 3:
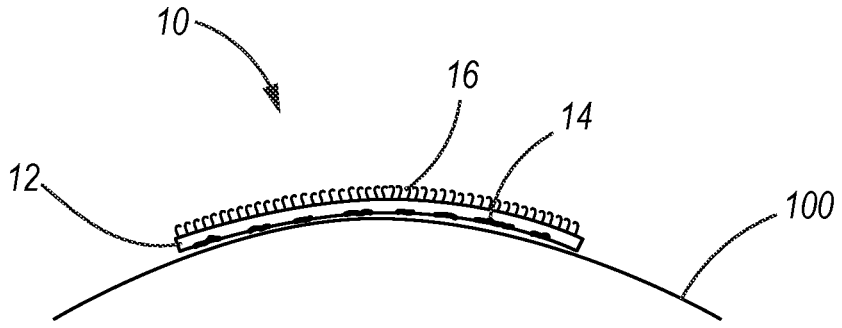
FIG. 3 shows a patch according to an embodiment of the disclosure applied to a user's skin.

FIG. 3 shows a patch 10 according to a further embodiment of the disclosure. Patch 10 includes a gripping layer 16 on its upper surface. According to one embodiment, gripping layer 16 is formed by the material forming fabric layer 12. According to this embodiment, fabric layer 12 includes fibers that protrude from the upper surface of patch 10 that will facilitate the removal of the patch form the skin, as will be explained more fully below. According to another embodiment, gripping layer 16 is a layer of material, such as the material forming the "loop" portion or a "hook-and-loop" fastener. Gripping layer 16 is selected to be translucent when wetted so that it allows a user's skin to be seen below the patch surrounding the simulated wound image 14.

Figure 4:
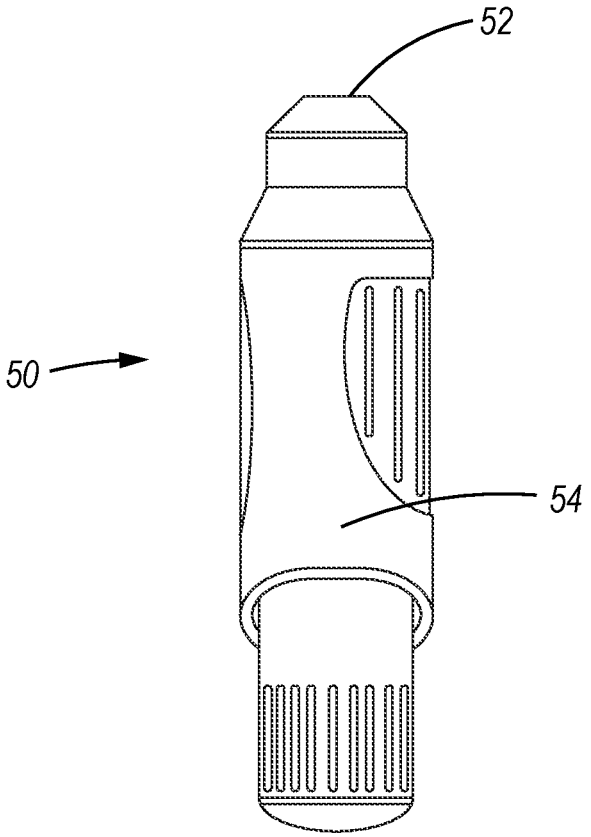
FIG. 4 shows a dispenser pen according to an embodiment of the disclosure.
Figure 5:
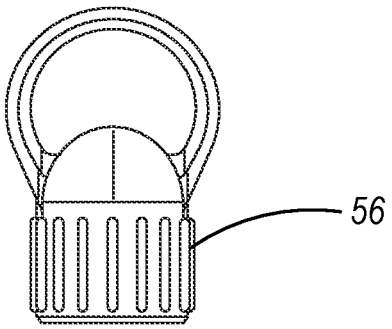
FIG. 5 shows a cap for the dispenser pen of FIG. 4 according to an embodiment of the disclosure.
Figure 6:
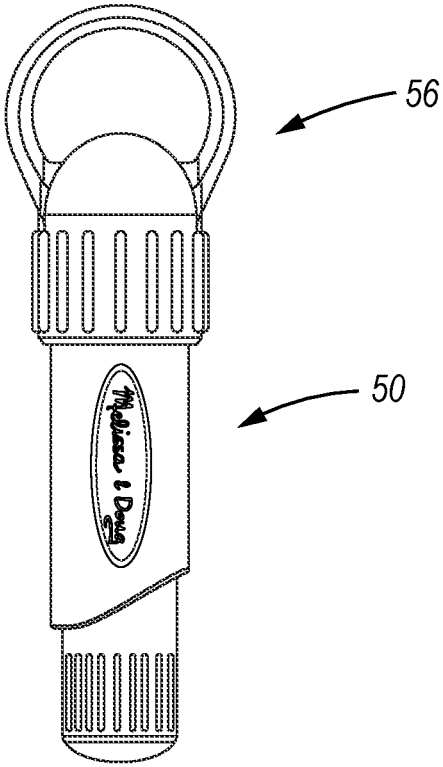
FIG. 6 shows the cap of FIG. 5 connected with the dispenser pen of FIG. 4.

FIG. 4 shows dispenser pen 50 according to embodiments of the disclosure. Dispenser 50 includes a reservoir 54 for holding a quantity of water or other liquid. A dispensing orifice 52 is provided at one end of dispenser 50. The size of orifice 52 is selected so that liquid from reservoir 54 can flow outward, for example, to apply liquid layer 18, shown in FIG. 1A and to wet or re-wet patch 10 to maintain the patch 10 in a saturated state. According to one embodiment, dispenser pen 50 is provided with a removable cap 56, shown in FIG. 5. According to one embodiment, cap 56 forms a friction fit over the end of dispenser pen 50 including orifice 52, closing orifice 52 to prevent liquid from unintentionally flowing out from reservoir 54. FIG. 6 shows cap 56 applied to pen 50. According to one embodiment, cap 56 includes a pintle (not shown) on its inside surface that is positioned to align with orifice 52 when the cap is fitted onto the dispenser. The pintle is shaped to extend into and plug orifice 52 to form a secure seal to prevent liquid from seeping out from reservoir 54.

Figure 7A:
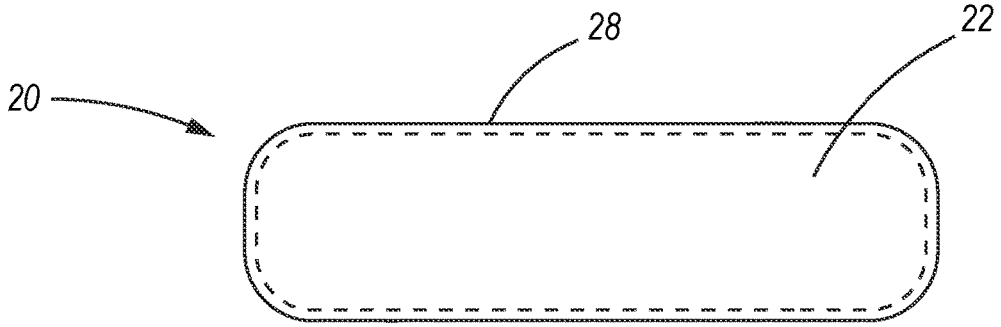
FIGS. 7A and 7B show the top side and bottom side, respectively, of a simulated bandage according to an embodiment of the disclosure.
Figure 7B:
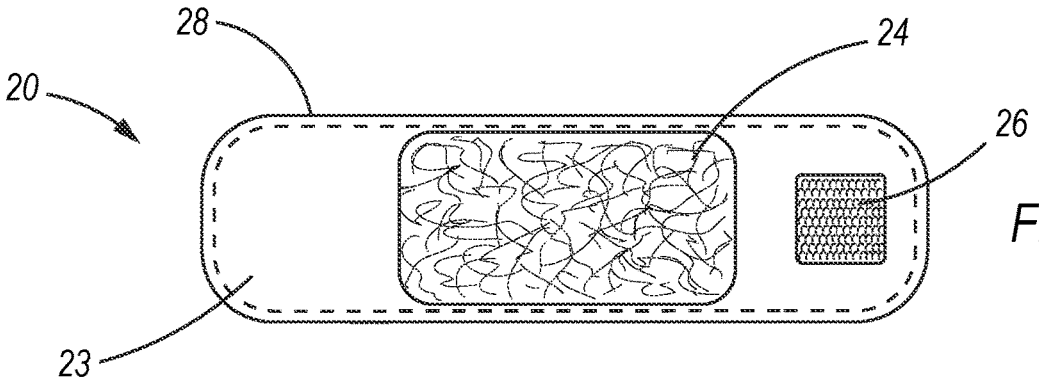
Figure 8:
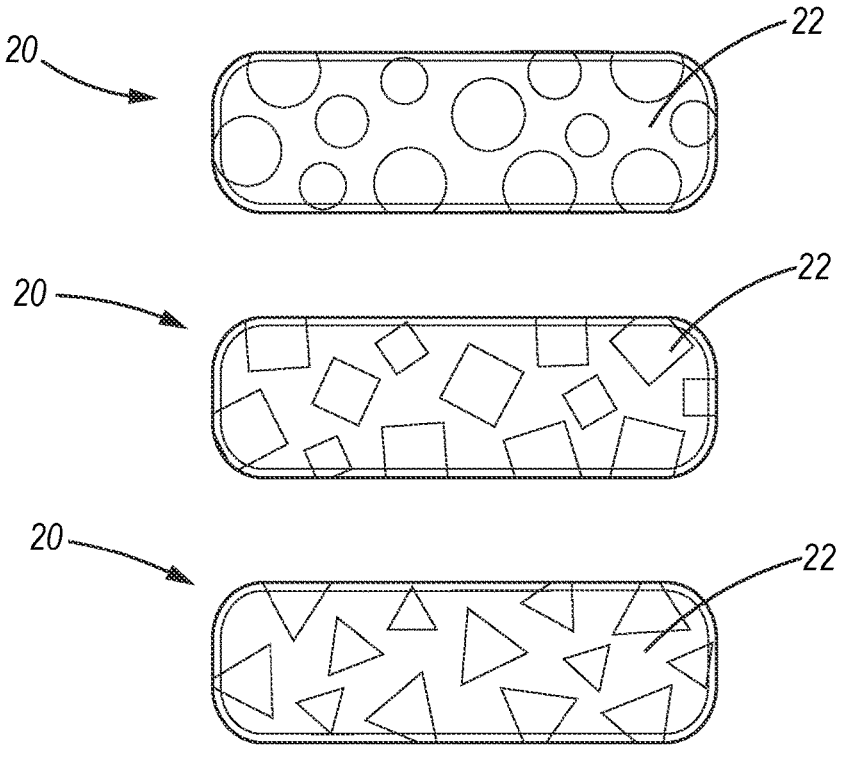
FIG. 8 show bandages according to embodiments of the disclosure with decorative images applied to top surfaces thereof.

FIGS. 7A and 7B show a simulated bandage 20 according to a further embodiment of the disclosure. Bandage 20 is formed from a flexible body 28. Body 28 has a top side 22, shown in FIG. 7A and a bottom side 23, shown in FIG. 7B. Top side 22 may include printing or other decoration to simulate the appearance of a real bandage. According to a further embodiment, shown in FIG. 8, top surface 22 may include decorative, colorful, or fanciful images.

Body 28 of bandage 20 is formed from a flexible material that can bend to at least partially conform to a three-dimensional shape such as the shape of a body part, such as a human limb. Body 28 may be formed from one or more of a natural or synthetic fabric, a polymer or elastomer sheet, leather, or other flexible material. According to a preferred embodiment, body 28 is formed from 2 mm thick white tricot fabric. According to one embodiment, the edges of body 28 include stitching to prevent the tricot fabric from fraying.

On the bottom surface 23 of bandage 20, as shown in FIG. 7B, a gripping portion 24 is provided. According to one embodiment, gripping portion 24 is formed from the same material that forms the "hook" portion of a "hook-and-loop" fastener. According to a preferred embodiment, gripping portion 24 is formed from nylon hook material. According to a more preferred embodiment, gripping portion 24 is formed from soft nylon and is selected to be safe in contact with human skin.

Bottom surface 23 of bandage 20 may also include retaining portion 26. According to one embodiment, retaining portion 26 is formed from "hook" material, such as the material forming gripping portion 24. The material forming retaining portion 26 is selected to removably engage with fibers of the fabric forming body 28 so that, when bandage 20 is wrapped around a body part, such as the user's finger, retaining portion 26 releasably connects with top surface 22 to temporarily hold bandage 20 onto the body part.

Figure 9:
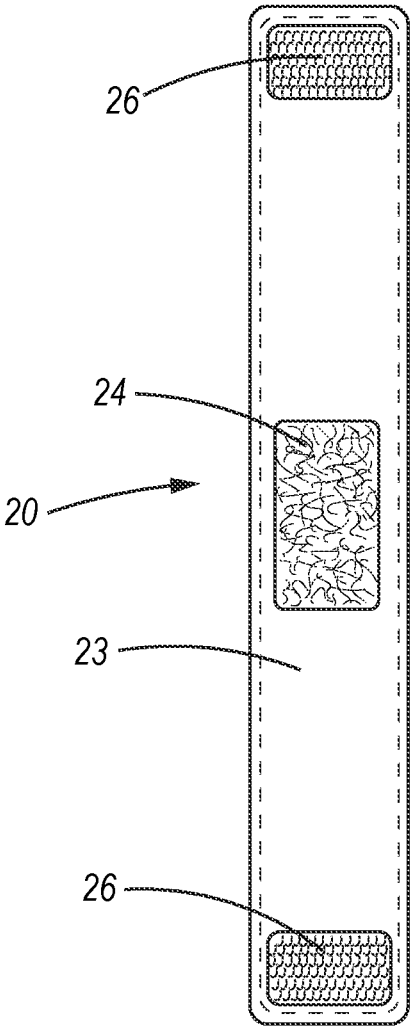
FIG. 9 show a simulated bandage according to an embodiment of the disclosure.

FIG. 9 shows the bottom side 23 of bandage 20 according to a further embodiment of the disclosure. In this embodiment, bandage 20 may be longer than in the previous embodiment. One or more gripping portions 24 and one or more retaining portions 26 are provided. As with the previous embodiment, retaining portions 26 interact with the top surface of the bandage to temporarily hold bandage 20 on the user's body. By providing a longer bandage 20, the embodiment in FIG. 9 can be affixed to a large body part, such as by being wrapped around an arm or leg.

The disclosure is not limited to bandages 20 that are rectangular. Other shapes are included within the scope of the disclosure, including, but not limited to round, square, oval, polygonal, star-shaped, or that are cut into a selected profile, for example, "Mickey Mouse Ears."

Figure 10A:
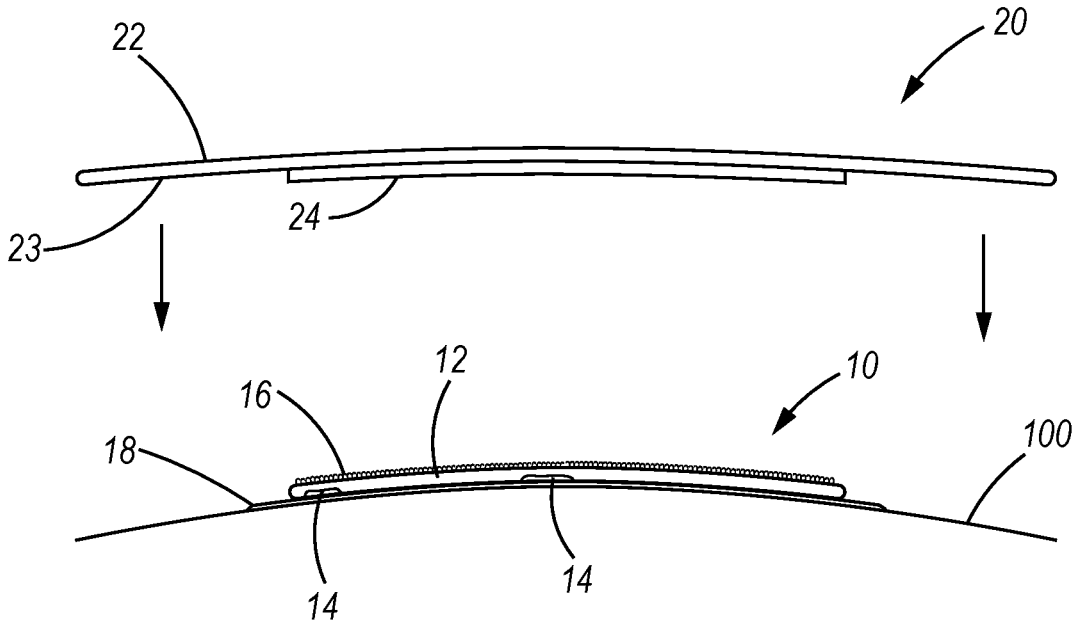
FIGS. 10A, 10B, and 10C show steps for applying a patch according to embodiments of the disclosure to a user's skin to create a simulated wound, for applying a simulated bandage according to an embodiment of the disclosure, and for removing the bandage and the patch from the skin.
Figure 10B:
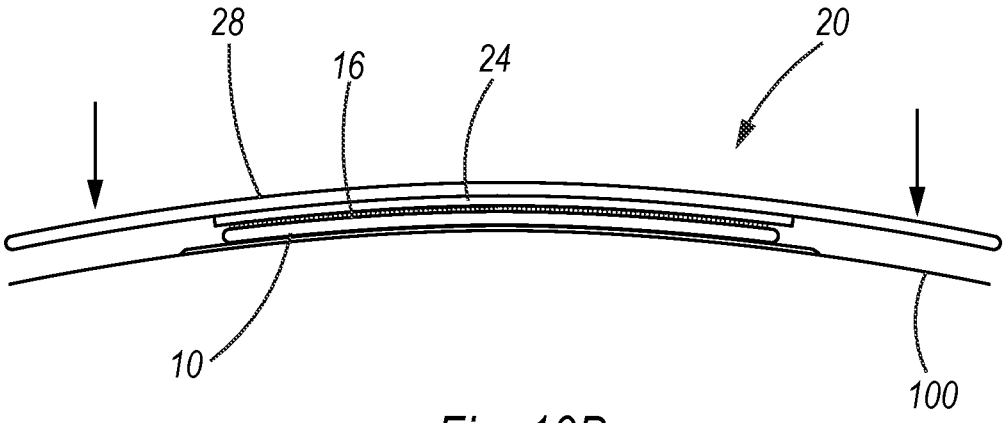
Figure 10C:
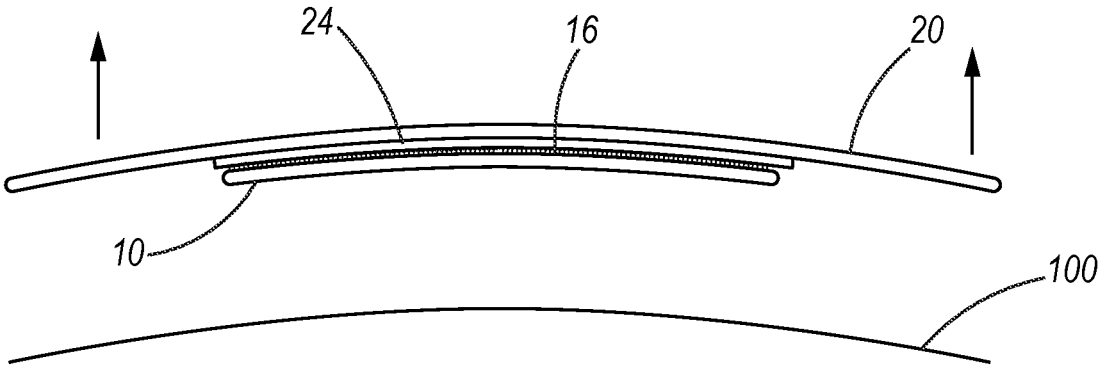

FIGS. 10A to 10C show a patch 10 and bandage 20 according to a further embodiment of the disclosure and steps for applying and removing the patch. FIG. 10A shows patch 10 adhered to skin 100 by a liquid layer 18. As discussed above, when fabric layer 12 forming patch 10 is saturated, it becomes translucent, allowing the color of skin 100 to be visible through the fabric. Patch 10 includes simulated wound image 14, such as one shown in FIGS. 2A to 2C. While patch 10 is saturated and adhered to skin 100, simulated wound image 14 creates the illusion that there is an actual wound on the skin.

As shown in FIG. 10B, bandage 20 is placed on top of patch 10. Gripping portion 24 contacts the top surface of patch 10. Fibers 16 on the top of patch 10 engage with hook fasteners on gripping portion 24, forming a temporary bond between patch 10 and bandage 20. As shown in FIG. 10C, when bandage 20 is lifted away from skin 100, patch 10 adheres to bandage 20, lifting the patch away from the skin and giving the appearance that the wound has healed. Because the surface tension forces holding the saturated patch 10 against the skin 100 are relatively weak, bandage 20 easily lifts patch 10 from the skin.

Figure 11A:
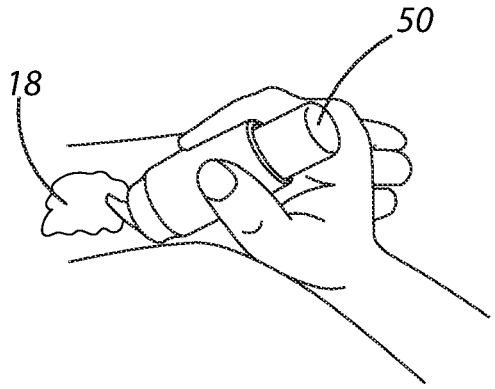
FIGS. 11A, 11B, 11C, 11D, and 11E show steps for applying a patch according to a further embodiment of the disclosure to a user's skin to create a simulated wound, for applying a simulated bandage according to a further embodiment of the disclosure, and for removing the bandage and the patch from the skin.

FIGS. 11A to 11E show steps for applying and removing patch 10 to create a simulated wound and to give the appearance of having healed the wound. As shown in FIG. 11A, a user applies a layer of water 18 to the skin. According to one embodiment, water is applied using a dispenser, such as dispenser pen 50, discussed above. According to other embodiments, water is applied using a brush, a spray bottle, a fingertip, a sponge, and the like. According to another embodiment, water is applied by immersing the user's limb in a container of water, such as in a bathtub while a child is bathing.

Figure 11B:
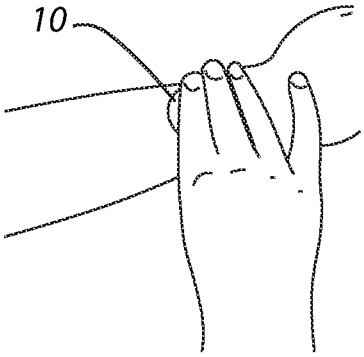
Figure 11C:
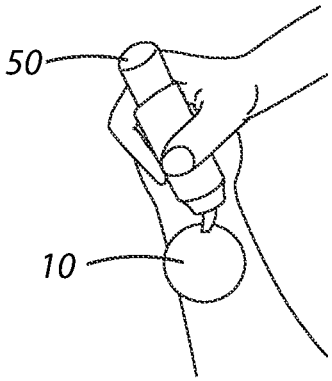
Figure 11D:
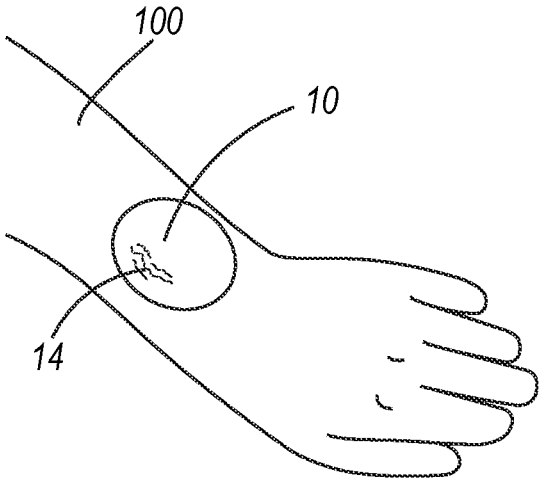
Figure 11E:
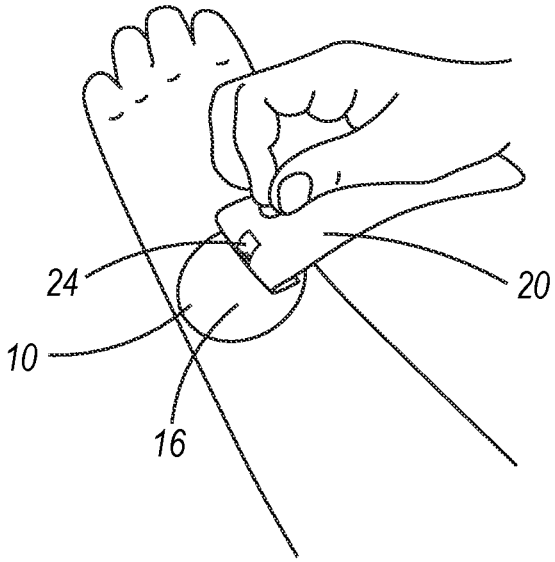

As shown in FIG. 11B, patch 10 is applied to the moistened skin. According to one embodiment, additional water may be applied to patch 10, as shown in FIG. 11C, to ensure that patch 10 is saturated so that the patch adheres to the skin and becomes translucent. As shown in FIG. 11D, saturated patch 10 adheres to the skin and displays simulated wound image 14 or other artwork surrounded by skin 100 surrounding the image. As shown in FIG. 11E, the user applies bandage 20 to patch 10. Gripper portion 24 of bandage 20 engages with gripping layer 16 of patch 10. When bandage 20 is pulled away from the skin, patch 10, along with the simulated wound image 14, revealing a "healed" wound.

Figure 12A:
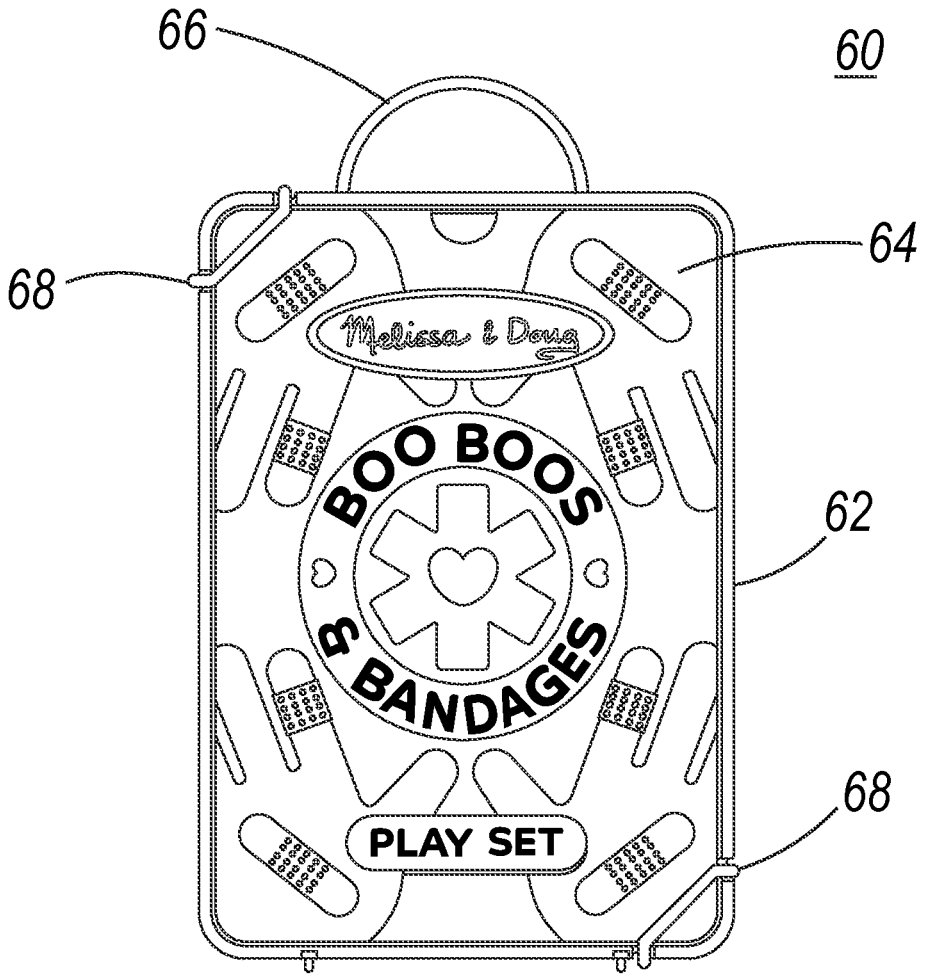
FIGS. 12A and 12B show a kit including a plurality of patches for creating simulated wounds, a plurality of simulated bandages, and a dispenser pen according to embodiments of the disclosure.

According to one embodiment of the disclosure, patches 10, bandages 20, and dispenser pen 50 are provided as components of kit 60. FIG. 12A shows the outside of kit 60 that includes housing 62 and lid 64 that form a convenient carrying case. Carrying handle 66 is provided. Handle 66 may be a loop of cord, a knob, a grip, a wooden handle, or other structure known in the field of the disclosure that facilitates carrying portable objects. According to the embodiment shown in FIG. 12A, lid 64 is fitted onto housing 62 by a clearance fit. One or more closures 68 connect with housing 62 and extend over the top surface of lid 64. Closures 68 may be elastic cords connected with housing 62 that are resiliently pulled over lid 64 to hold it to the housing. According to other embodiments, lid 64 is connected to housing 62 by one or more hinges so that the lid can swing away from housing 62 to expose the contents of the housing.

Figure 12B:
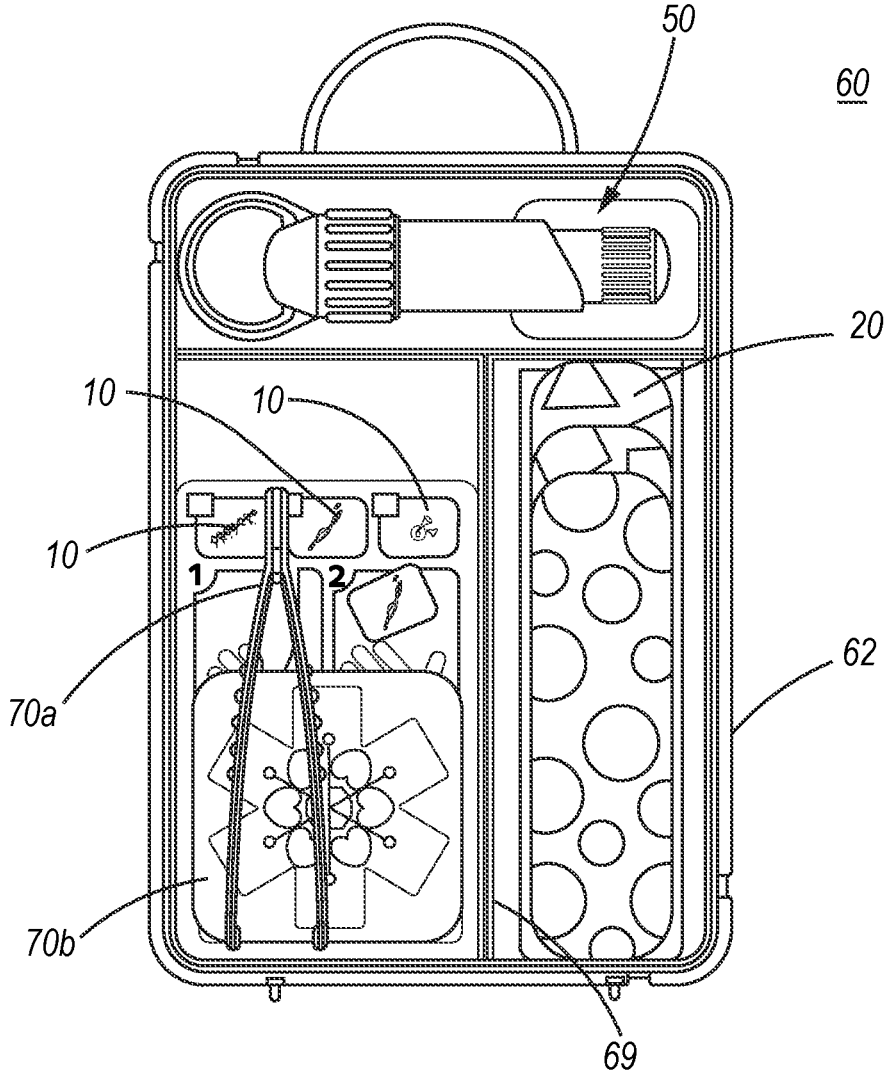

FIG. 12B shows kit 60 with lid 64 removed. Kit 60 includes one or more patches 10, one or more bandages 20, and a dispenser pen 50, such as those described above. Housing 62 may include one or more dividers 69 that define compartments to house components of the kit. Kit 60 includes a plurality of patches 10 in one such compartment. Patches 10 may have a variety of simulated wounds printed thereon as described above. Kit 60 includes a plurality of simulated bandages 20 held in another compartment. Kit 60 also includes dispenser pen 50 held in another compartment. According to some embodiment, kit 60 also includes other objects that relate to providing first aid, for example, tweezers 70*a* and a hot/cold pack 70*b*.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims. Therefore, the description should not be construed as limiting the scope of the invention.

What is claimed is:

1. A patch adapted to display a simulated wound, the patch comprising:

a fabric layer having a first translucency when dry and a second, greater translucency when saturated with a liquid; and a simulated wound applied to the fabric layer, wherein, when the fabric layer is applied to a skin of a user and is saturated to achieve the second translucency, a color of the user's skin is visible through the patch, and wherein the simulated wound is visible on the patch to display the simulated wound.

2. The patch of claim 1, further comprising a gripping layer on a top surface of the fabric layer.

3. The patch of claim 2, wherein the gripping layer comprises fibers that protrude from the upper surface of the patch.

4. The patch of claim 3, wherein the fibers form loops protruding from the top surface.

5. The patch of claim 1, wherein the fabric layer is white or a neutral color.

6. The patch of claim 1, wherein the fabric layer comprises one or more of a woven textile, a non-woven textile, a natural textile, a synthetic textile, cotton, wool fabric, gauze, muslin, linen, polyethylene, or polypropylene.

7. The patch of claim 6, wherein the fabric layer comprises non-woven polypropylene.

8. The patch of claim 1, wherein the simulated wound image is applied to the fabric layer by one or more of printing, screen printing, thermal transfer printing, and hand drawing.

9. The patch of claim 1, wherein the liquid comprises one or more of water, sea water, an aqueous dye solution, a non-aqueous material, mineral oil, petroleum jelly, baby oil, hand lotion, and sunscreen.

10. A kit for creating a simulated wound comprising:

the patch of claim 1; and a liquid dispenser adapted to deliver the liquid to the skin.

11. The kit of claim 10, wherein the dispenser comprises a reservoir and a dispensing opening in fluid connection with the reservoir, wherein a limited flow of the liquid flows from the reservoir, through the opening, and onto the user's skin.

12. The kit of claim 11, wherein the dispenser includes a cap removably connected with the dispenser and adapted to close the opening to prevent the liquid from flowing from the reservoir.

13. A simulated bandage comprising:

a thin, flexible body having a bottom side, wherein the body is adapted to at least partially conform to a three-dimensional shape;

a gripping portion on at least a portion of the bottom side a patch adapted to create a simulated wound, the patch comprising:

a fabric layer having a first translucency when dry and a second, greater translucency when saturated with a liquid;

a simulated wound applied to the fabric layer, wherein, when the fabric layer is placed on a skin surface and is saturated to achieve the second translucency, a color of the skin surface is visible through the patch, and wherein the simulated wound is visible on the patch when the patch is saturated; and a gripping layer on a top surface of the fabric layer, wherein the gripping portion of the flexible body engages with the gripping layer of the patch, and wherein movement of the flexible body away from the skin pulls the patch from the skin to remove the simulated wound.

14. The bandage of claim 13, wherein the gripping portion comprises a plurality of hooks.

15. The bandage of claim 14, wherein the gripping portion comprises a hook component of a hook-and-loop fastener.

16. The bandage of claim 13, wherein the gripping portion of the flexible body comprises a plurality of hooks, wherein the gripping layer of the patch comprises a plurality of loops, and wherein engagement of the body with the patch comprises interengagement of at least a portion of the hooks with at least a portion of the loops.

17. A method for creating a simulated wound comprising, providing a patch comprising a fabric layer having a first translucency when dry and a second, greater translucency when saturated with a liquid, wherein a simulated wound is applied to the fabric layer;

providing a simulated bandage comprising a thin, flexible body having a bottom side, wherein the body is adapted to at least partially conform to a three-dimensional shape and wherein the body includes a gripping portion on at least a portion of the bottom side;

applying the liquid to a skin surface to create a liquid layer;

applying the patch to the liquid layer, wherein liquid in the liquid layer saturates the fabric layer to achieve the second translucency, wherein a color of the skin is visible through the patch, and wherein the simulated wound is visible on the patch when the patch is saturated with the liquid;

applying the simulated bandage to the patch with the gripping portion in contact with fabric layer, wherein the gripping portion engages with the fabric layer.

18. The method of claim 17, further comprising applying an additional amount of the liquid to the patch after the step of applying the patch to the liquid layer.

19. The method of claim 17, further comprising moving the bandage away from the skin, wherein the patch remains engaged with the bandage and the patch is removed from the skin.

* * * * *